United States Patent [19]

Himmelwright

[11] Patent Number: 4,477,565

[45] Date of Patent: Oct. 16, 1984

[54] METHOD FOR PREPARING PHOTOSENSITIVE SILVER HALIDE EMULSION

[75] Inventor: Richard S. Himmelwright, Melrose, Mass.

[73] Assignee: Polaroid Corporation, Cambridge, Mass.

[21] Appl. No.: 462,804

[22] Filed: Feb. 2, 1983

[51] Int. Cl.[3] ..... G03C 1/02

[52] U.S. Cl. ..... 430/567; 430/569

[58] Field of Search ..... 430/569, 567

[56] References Cited

U.S. PATENT DOCUMENTS 4,067,739 1/1978 Lewis ..... 430/567

OTHER PUBLICATIONS

Photo. Korr. 105 Band N5, 1969, pp. 77–82.

Research Disclosure, Aug. 1983, #23212.

*Primary Examiner*—Mary F. Downey

*Attorney, Agent, or Firm*—Philip G. Kiely

[57] ABSTRACT

Silver halide emulsions having tabular grains with a mean aspect ratio of at least 10 are prepared by inducing twinning on the (111) crystal plane in silver bromide grains and then growing the grains in a silver halide solvent solution for a time sufficient to provide said tabular grains.

17 Claims, 6 Drawing Figures

METHOD FOR PREPARING PHOTOSENSITIVE SILVER HALIDE EMULSION

BACKGROUND OF THE INVENTION

Silver halide grains which are tabular in habit are known in the art. Such grains are thin, flat, twinned octahedra of triangular or hexagonal shape. Some tabular grains are found in many conventional emulsions, but only a very small proportion of the grains are tabular in such emulsions. Single jet emulsions having relatively wide grain size distribution generally contain some tabular grains. It has been desirable to remove such tabular grains or avoid their formation to narrow the grain size distribution of such emulsions to yield so-called monodisperse emulsions since it is known that tabular grains grow at substantially faster rates than grains of other crystal morphologies.

The use of an emulsion having a preponderance of tabular grains in a photographic element is, however, considered desirable. For example, the thin, flat crystal morphology provides silver halide grains having substantially increased surface to volume ratios compared to equivalent volume conventional "chunky" silver halide grains. It is believed that these enhanced ratios can permit higher levels of sensitizing dye to be employed (per given mass of silver halide) resulting in an improved photoreceptor and thus increased photographic speed. This described increased surface area to volume ratio also provides for an increased potential for reactions with developers, antifoggants, chemical sensitizers and other photographic addenda, as well as enhanced covering power.

Photographic emulsions having tabular grains are reported in the literature, but generally suffer from various deficiencies in method of preparations or final product. Such deficiencies include preparation of grains that are too large for use in a photographic element (not photographically useful) or grains that are of too low an aspect ratio that they cannot take advantage of, for example, increased sensitizing dye levels. Many of such preparations reported in the literature are cumbersome or difficult to control.

In C. R. Berry and D. C. Skillman, "Fundamental Mechanisms in Silver Halide Precipitation", *The Journal of Photographic Science,* vol. 16, (1968) pgs. 137–147, a method is described wherein tabular grains are prepared by a double jet precipitation where 2N solutions of silver nitrate and potassium bromide are added simultaneously to a 3% gelatin solution at 30° C. and pAg of 8. Stable cubes of silver bromide are formed. At the end of the precipitation, the formation and growth of the platelet grains occurs by raising the temperature to 50° C. and the pAg to 9.9 by adding excess potassium bromide to the system. Addition of the excess bromide yields twinning and after a prolonged Ostwald ripening period tabular grains are produced. Referring to the photomicrograph on page 143 it will be noted that while there are present a number of large grains described by the authors as "thin tabular crystals" there are also visible a large number of very small grains which were formed by the double jet precipitation. Thus, it would appear that if the Ostwald ripening was halted when the tabular grains are at a size where they are photographically useful there would be present an undesireably large population of the very small grains. Conversely, carrying out the Ostwald ripening to substantially eliminate the very small grains, extremely large tabular grains would result, beyond the range of photographic usefulness.

In C. R. Berry, S. J. Marino and C. F. Oster, "Effects of Environment on the Growth of Silver Bromide Microcrystals", *Photographic Science and Engineering,* vol. 5, no. 6 (Nov.–Dec. 1961) pages 332–336, methods for the growth of tabular silver bromide grains are described. The method involved the simultaneous addition at equal rates of silver nitrate and potassium bromide solutions to a mixing vessel containing a gelatin solution. A variety of growth modifiers were added to the gelatin solution. It is stated that the only condition that produced an appreciable change in grain size and shape was the addition of potassium bromide to the mixing vessel to produce a pAg of 10.3 during precipitation. Approximately 20% of the crystals formed were tabular, with the remaining being octahedra and needle-like. The article also states that at a pAg below 10.3, i.e. at 9.7, a mixture of small cubes, tetrahedra and octahedra are formed, but no tabular grains. All tabular formation and growth takes place during precipitation. In addition, it is also pointed out that only untwinned octahedra are formed when ammonia is present as a growth modifier.

U.S. Pat. No. 4,150,994, issued Apr. 24, 1979, is directed to a method of preparing a silver halide emulsion wherein the crystals are of the twinned octahedral or cubic type which comprises forming a dispersion of silver iodide nuclei in gelatin, mixing silver nitrate and bromides or chlorides to form twinned crystals, Ostwald ripening in the presence of silver halide solvent solution and controlled silver ion concentration, optionally causing the twinned crystals to increase in size by adding further silver salt solution and halide salts and then removing the water-soluble salts formed and chemically sensitizing the emulsion.

U.S. Pat. No. 4,063,951, issued Dec. 20, 1977, is directed to silver halide emulsions wherein the crystals are of tabular habit bounded by (100) cubic faces and which have an aspect ratio of from 1.5:1 to 7:1. The crystals are prepared by adding an aqueous solution of a water-soluble halide and an aqueous solution of silver nitrate to an aqueous colloid medium by a double jetting technique at a controlled pAg value of between 4.0 and 8.0 and at a controlled constant temperature within the range of 35°–75° to produce monodispersed untwinned seed crystals and then allowing the seed crystals to increase in size by Ostwald ripening in the presence of sufficient ammonia and alkali halide to favour the cubic habit of the crystals at a temperature of between 35° to 70 °.

In F. H. Claes "Crystal Growth and Reactivity Sites of Twinned-Tabular Grains", F. H. Claes, *Photogaphische Korrespondenz Band,* 101, 139–144, (1965), it is stated that the preparation of tabular crystals must occur in the absence of ammonia; if not, a three-dimensional crystal growth occurs. If precipitation does occur in an ammoniacal medium, tabular crystal growth can subsequently be obtained if the ammonia is removed from the emulsion before ripening.

A novel method for preparing tabular grains has now been found which is not susceptible to the deficiencies of the prior art.

SUMMARY OF THE INVENTION

The present invention is directed to a method for forming a photosensitive silver halide emulsion wherein the grains are predominantly tabular grains which are multiply twinned on the (111) plane and possess a mean aspect ratio of at least 10, which comprises inducing twinning in silver bromide grains, and then growing said grains in a solution of silver halide solvent for a time sufficient to provide said tabular silver halide grains.

DETAILED DESCRIPTION OF THE INVENTION

The present invention is directed to a method for providing for the rapid growth of high aspect ratio tabular silver halide grain emulsions without a significant amount of very small feedstock grains. Thus, tabular grains having a mean aspect ratio of at least 10, and preferably 20–40, are prepared with at least a 50% reduction in growth time compared to a growth procedure which does not include a silver halide solvent. It should also be noted that this increase in growth rate is acheived without altering the crystal morphology. Tabular grains prepared by the present invention include pure silver bromide, silver chlorobromide, silver iodobromide and silver iodochlorobromide.

Figure 1:
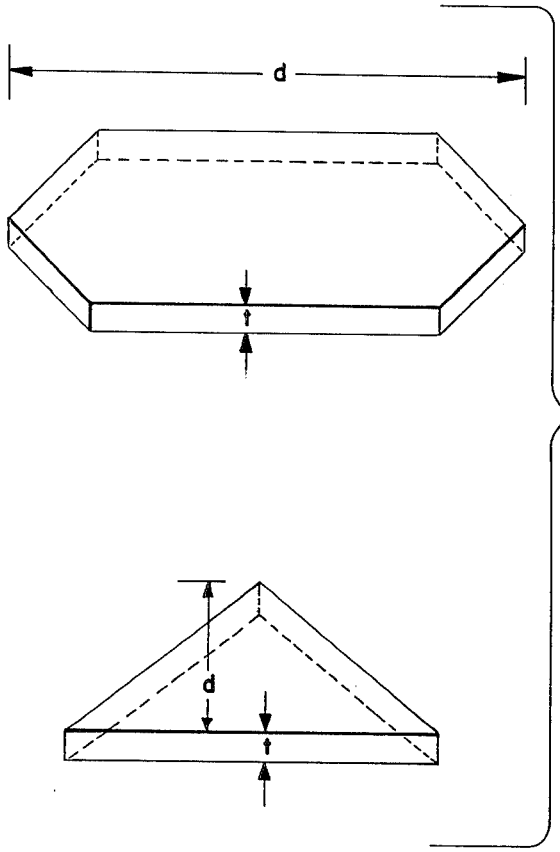
FIG. 1 is a representation of the two shapes of tabular grains.

The term "aspect ratio", as used herein, is intended to refer to the ratio of crystal diameter (d) to crystal thickness (t) as shown in FIG. 1 wherein a hexagonal and a triangular crystal are illustrated.

The present invention also provides for the rapid preparation of high-aspect pure silver bromide tabular grains in contradistinction to the above described prior art, U.S. Pat. No. 4,150,994, which, as described above, requires silver iodide nuclei in the first stage of precipitation, thus precluding the preparaion of pure silver bromide grains. If desired, however, silver iodobromide, silver iodochlorobromide or silver chlorobromide can be prepared by the method of the present invention by incorporating into the grain during the growth step up to about 10 mole percent of iodide, or chloride or both iodide and chloride. This chloride and/or iodide incorporation is achieved by adding alkali or ammonium iodide or chloride during the growth step.

Any suitable silver halide solvent known to the art and combinations thereof may be employed in the practice of the present invention. As examples of such solvents mention may be made of the following: sodium thiosulfate, ammonium thiocyanate, potassium thiocyanate, sodium thiocyanate; thioethers such as thiodiethanol; ammonium hydroxide, organic silver complexing agents, such as ethylene diamine and higher amines. In a preferred embodiment, ammonium hydroxide is employed. The term "silver halide solvent", as used herein, refers to any compound, molecule or ion that is capable of forming a stable complex with silver ions in an aqueous solution.

It is critical in the present invention that the silver halide solvent be added after the silver bromide grains have been twinned. Twinning is induced in the untwinned silver bromide feedstock by raising the pAg from the pAg at which the grains are formed, preferably below 9.7, to between 9.8 and 11.8.

The concentrations of silver halide solvent employed may be varied over a relatively wide range depending upon the accelerated growth rate desired. For example, in the case of ammonium hydroxide, the molarity of the solution can be substantially any value greater than about 0.01M to obtain a beneficial increase in growth rate.

The feedstock, which must consist essentially of pure silver bromide, are grains preferably about 0.1 to 0.2 micrometers in mean volume diameter. Feedstock grains within this range provide a preferred aspect ratio of 20 to 40 with a mean grain volume of about 2 cubic micrometers. The feedstock grains should be employed relatively soon after precipitation is complete, since holding the grains after precipitation and before twinning results in annealing which reduces the tendency to twinning in the grains. Preferably, twinning and growth immediately follows precipitation and is carried out in the same vessel.

In a preferred embodiment, predominantly tabular grains which are multiply twinned on the (111) plane and possess a mean aspect ratio of at least 10, are prepared by the following steps, in sequence:

(a) precipitating silver bromide grains at a pAg of not greater than about 9.7;

(b) adjusting the pAg to between about 9.8 and 11.8 to induce twinning on the (111) crystal plane in said grain; and (c) growing said grains in a solution of a silver halide solvent for a time sufficient to provide said tabular grains.

In a preferred embodiment, about 80% (by number) of the grains are tabular.

Thus, the present invention is directed to the rapid preparation of silver halide grains bounded by (111) crystal planes exhibiting a high aspect ratio (at least 10) and twinned in the (111) crystal plane. For comparison, it should be noted that above-mentioned U.S. Pat. No. 4,063,951 describes tabular grains bounded by (100) crystal planes with a very low aspect ratio (1.5:1 to 7:1).

It should also be noted, that the tabular grains of the present invention are prepared, in a preferred embodiment in the presence of ammonia, whereas Claes, referenced above, states that tabular crystal growth can be obtained only if ammonia is removed before ripening.

The following non-limiting examples illustrate the novel procedure of the present invention.

EXAMPLE 1 (Control)

The following solutions were prepared:

| | |
|---|---|
| Solution A | |
| Phthalated gelatin | 54.3 g |
| Water | 1545.7 g |
| Solution B | |
| Silver nitrate | 339.7 g |

-continued

| | |
|---|---|
| Water | 921.9 g |
| Solution C | |
| Potassium bromide | 238.0 g |
| Water | 913.5 g |
| Solution D | |
| Potassium bromide | 59.5 g |
| Water | 978.4 g |

Solution A was placed in a make vessel at 50° C. To Solution A was added, simultaneously, 500 ml each of Solutions B and C under pAg control at pAg 7.8–8.0 at a flow rate of 50 mL/min. At the end of the addition period, the temperature was raised to 60° C. and about 560 mL of Solution D was added to provide a pAg of about 10.2. The grains were allowed to grow until all of the small feedstock crystals disappeared, which required about 90 min.

EXAMPLE 2

| | |
|---|---|
| Solution A | |
| Phthalated gelatin | 54.3 g |
| Water | 1545.7 g |
| Solution B | |
| Silver nitrate | 339.7 g |
| Water | 921.9 g |
| Solution C | |
| Potassium bromide | 238.0 g |
| Water | 913.5 g |
| Solution D | |
| Potassium bromide | 59.5 g |
| Water | 978.4 g |
| Solution E | |
| Ammonium hydroxide | 43.0 g |
| Water | 157.0 g |

Solution A was placed in a make vessel at 50° C. To Solution A was added, simultaneously, 500 mL each of Solutions B and C under pAg control at pAg 7.8–8.0 at a flow rate of 50 mL/min. At the end of the addition period, the temperature was raised to 60° C. and about 560 mL of Solution D was added to provide a pAg of about 10.2. 27.5 min after the addition of Solution D (twinning induced) Solution E was added. The grains were allowed to grow until all of the small feedstock crystals disappeared, which required about min after the addition of Solution D.

Figure 2:
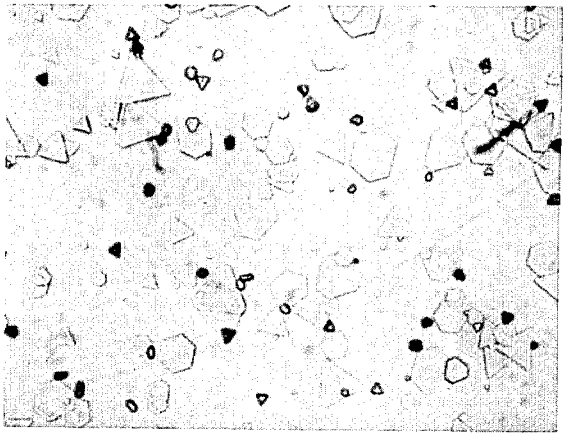
FIG. 2 is an optical micrograph at 1200X magnification of the grains prepared in Example 1.
Figure 3:
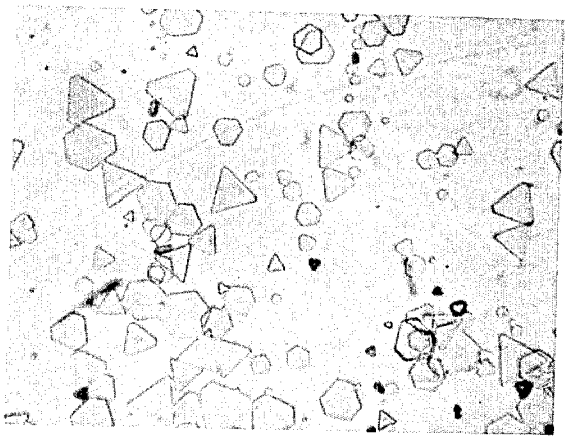
FIG. 3 is an optical micrograph at 1200X magnification of the grains of the invention prepared in Example 2.

The mean volume of the grains prepared in Example 1 and 2 was obtained using a Coulter Counter and found to be 1.99 cubic micrometers for the grains of Example 1 and 2.04 cubic micrometers for Example 2. The mean aspect ratios were found to be about 22.5 for the grains of both Examples 1 and 2. FIGS. 2 and 3 are optical micrographs at 1200X magnification which show the tabular grains prepared in Examples 1 and 2, respectively.

Thus, a comparison of Examples 1 and 2 show a particular advantage of the method of the present invention, namely a 50% reduction in grain growth time, while the number and size of the grains prepared by each method are substantially the same.

Example 3

| | |
|---|---|
| Solution A | |
| Phthalated gelatin | 54.3 g |
| Water | 1545.7 g |

-continued

| | |
|---|---|
| Solution B | |
| Silver nitrate | 339.7 g |
| Water | 921.9 g |
| Solution C | |
| Potassium bromide | 238.0 g |
| Water | 913.5 g |
| Solution D | |
| Potassium bromide | 59.5 g |
| Water | 978.4 g |
| Solution E | |
| Ammonium hydroxide | 43.0 g |
| Water | 157.0 g |

Figure 4:
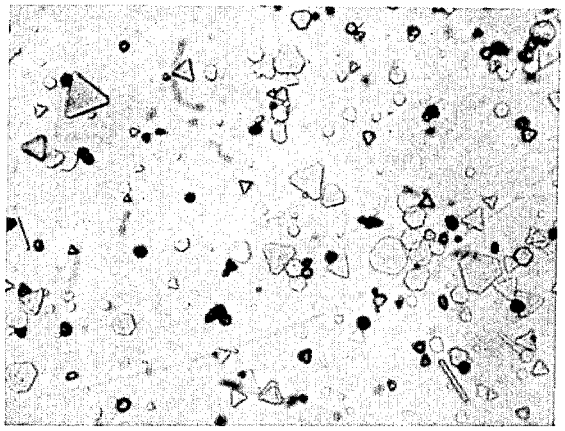
FIG. 4 is an optical micrograph at 1200X magnification of the grains of the invention prepared in Example 3.

Solution A was placed in a make vessel at 50° C. To Solution A was added, simultaneously, 500 mL each of Solutions B and C under pAg control at pAg 7.8–8.0 at a flow rate of 50 mL/min. At the end of the addition period, the temperature was raised to 60° C. and about 560 mL of Solution D was added to provide a pAg of about 10.2. 1 min after the addition of Solution D (twinning induced) Solution E was added. The grains were allowed to grow until all of the small feedstock crystals disappeared, which required about min after the addition of Solution D. FIG. 4 is an optical micrograph at 1200X magnification of the grains prepared in Example 3. The mean volume of the grains is about 1.75 cubic micrometers which is slightly smaller than that of the grains of the control emulsion of Example 1. However, the tabular grains of Example 3 were grown in only 22 min compared to the 90 min necessary for Example 1.

EXAMPLE 4

| | |
|---|---|
| Solution A | |
| Phthalated gelatin | 54.3 g |
| Water | 1545.7 g |
| Solution B | |
| Silver nitrate | 339.7 g |
| Water | 921.9 g |
| Solution C | |
| Potassium bromide | 238.0 g |
| Water | 913.5 g |
| Solution D | |
| Potassium bromide | 59.5 g |
| Water | 978.4 g |
| Solution E | |
| Ammonium hydroxide | 43.0 g |
| Water | 157.0 g |

Figure 5:
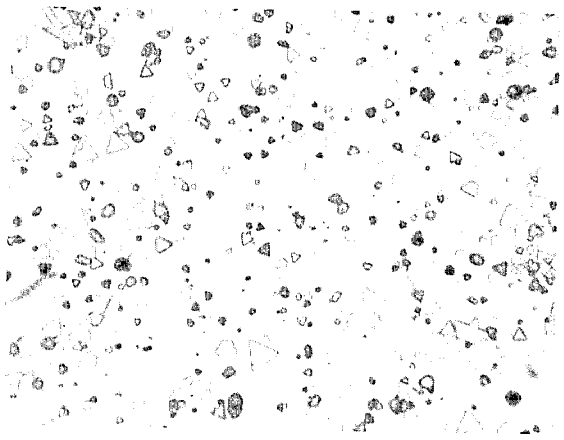
FIG. 5 is an optical micrograph at 1200X magnification of the grains of the invention prepared in Example 4.
Figure 6:
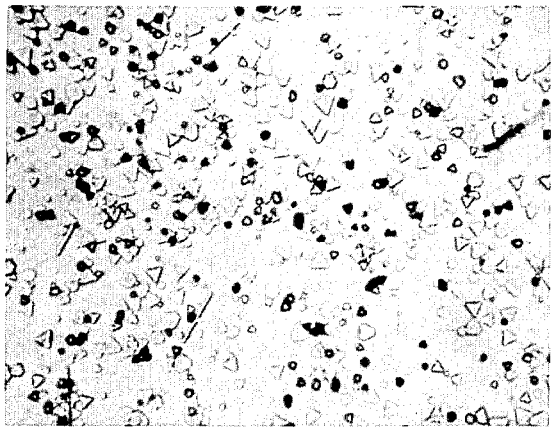
FIG. 6 is an optical micrograph at 1200X magnification of the grains of the invention prepared in Example 5.

Solution A was placed in a make vessel at 50° C. To Solution A was added, simultaneously, 500 mL each of Solutions B and C under pAg control at pAg 7.8–8.0 at a flow rate of 50 mL/min. At the end of the addition period, the temperature was raised to 60° C. and about 560 mL of Solution D was added to provide a pAg of about 10.2. 5 min after the addition of Solution D (twinning induced) Solution E was added. The grains were allowed to grow until all of the small feedstock crystals disappeared, which required about 22 min after the addition of Solution D. FIG. 5 is an optical micrograph at 1200X of the grains prepared in Example 4. It will be noted that the grain size, distribution of grain size and growth time are substantially the same as in Example 3 with only a slight reduction in grain volume. Thus, it will be seen that there is some flexibility in the method of the present invention, providing, however, that twinning is induced prior to the silver halide solvent addition.

EXAMPLE 5

| | |
|---|---|
| Solution A | |
| Phthalated gelatin | 54.3 g |
| Water | 1545.7 g |
| Solution B | |
| Silver nitrate | 339.7 g |
| Water | 921.9 g |
| Solution C | |
| Potassium bromide | 238.0 g |
| Water | 913.5 g |
| Solution D | |
| Potassium bromide | 59.5 g |
| Water | 978.4 g |
| Solution E | |
| 1,8-dihydroxy-3,6-dithia-octane | 1.0 g |
| Water | 100.0 g |

Solution A was placed in a make vessel at 50° C. To Solution A was added, simultaneously, 500 mL each of Solutions B and C under pAg control at pAg 7.8–8.0 at a flow rate of 50 mL/min. At the end of the addition period, the temperature was raised to 60° C. and about 560 mL of Solution D was added to provide a pAg of about 10.2. 20 min after the addition of Solution D (twinning induced) Solution E was added. The grains were allowed to grow until all of the small feedstock crystals disappeared, which required about 40 min after the addition of Solution D.

What is claimed is:

1. A method for forming a photosensitive silver halide emulsion wherein the grains are predominantly tabular grains which are multiply twinned on the (111) plane and possess a mean aspect ratio of at least 10 which comprises inducing twinning in feedstock silver bromide grains and then growing said grains in a silver halide solvent solution for a time sufficient to provide said tabular grains and substantially all of said feedstock grains have disappeared.

2. The method of claim 1 wherein said silver bromide grains are about 0.1 to 0.2 micrometers in mean volume diameter prior to twinning.

3. The method of claim 1 wherein said twinning is induced by adjusting the pAg from the pAg at which the grains are formed to about 9.8 to 11.8.

4. The method of claim 1 wherein said silver halide solvent is ammonium hydroxide.

5. The method of claim 1 wherein said silver halide solvent is 1,8-dihydroxy-3,6-dithia-octane.

6. The method of claim 1 wherein the mean aspect ratio is about 20 to 40.

7. The method of claim 4 wherein said pAg is adjusted by adding alkali bromide to said silver bromide grains.

8. The method of claim 1 which comprises adding alkali or ammonium iodide and/or chloride during said growing of said grain.

9. The method of claim 1 wherein said emulsion is about 80% by number tabular grains.

10. A method for forming a photosensitive silver halide emulsion wherein the grains are predominantly tabular grains which are multiply twinned on the (111) plane and possess a mean aspect ratio of at least 10 which comprises the following steps, in sequence, (a) precipitating feedstock silver bromide grains at a pAg of not greater than about 9.7;

(b) adjusting the pAg to between about 9.8 and 11.8 to induce twinning on the (111) crystal plane in said grains; and (c) growing said grains in a solution of a silver halide solvent for a time sufficient to provide said tabular grains and substantially all of said feedstock grains have dissappeared.

11. The method of claim 10 wherein said silver bromide grains formed in step (a) are about 0.1 to 0.2 micrometers mean volume diameter.

12. The method of claim 10 wherein said pAg is adjusted by adding alkali bromide to said silver bromide grains.

13. The method of claim 10 wherein said silver halide solvent is ammonium hydroxide.

14. The method of claim 10 wherein said silver halide solvent is 1,8-dihydroxy-3,6-dithia-octane.

15. The method of claim 10 which comprises adding alkali or ammonium iodide and/or chloride during said growing of said grains.

16. The method of claim 10 wherein said mean aspect ratio is 20 to 40.

17. The method of claim 10 wherein said emulsion is about 80% tabular grains.

* * * * *